US009366040B2

(12) United States Patent
Singh

(10) Patent No.: US 9,366,040 B2
(45) Date of Patent: Jun. 14, 2016

(54) WALL PANEL TRIM REVEAL SYSTEM AND METHOD

(75) Inventor: Joshua George Singh, Calgary (CA)

(73) Assignee: EASYTRIM REVEALS INC., Calgary, AB (CA)

( * ) Notice: Subject to any disclaimer, the term of this patent is extended or adjusted under 35 U.S.C. 154(b) by 0 days.

(21) Appl. No.: 13/194,451

(22) Filed: Jul. 29, 2011

(65) Prior Publication Data

US 2012/0255249 A1 Oct. 11, 2012

Related U.S. Application Data

(60) Provisional application No. 61/474,135, filed on Apr. 11, 2011.

(51) Int. Cl.
*E04F 19/02* (2006.01)
*E04F 19/06* (2006.01)

(52) U.S. Cl.
CPC ..... *E04F 19/061* (2013.01); *E04F 19/022* (2013.01); *E04F 19/062* (2013.01); *E04F 19/064* (2013.01); *E04F 19/065* (2013.01)

(58) Field of Classification Search
CPC ..... E04F 19/061; E04F 19/064; E04F 19/022; E04F 19/065; E04F 19/062
USPC ..... 52/62, 169.5, 281, 282.1, 287.1, 288.1, 52/716.2, 716.8, 717.01
See application file for complete search history.

(56) References Cited

U.S. PATENT DOCUMENTS 1,029,106 A * 6/1912 Collins ..... 52/371
1,503,929 A * 8/1924 Tracy et al. ..... 52/288.1
2,188,090 A * 1/1940 Young ..... 52/459
2,249,125 A * 7/1941 Gabriel ..... 52/553
3,343,323 A * 9/1967 Mayfield ..... 52/302.3
3,828,499 A * 8/1974 Leddy ..... 52/278
4,607,567 A * 8/1986 Esposito ..... 454/347
4,825,612 A * 5/1989 Tupman ..... 52/371
5,027,572 A * 7/1991 Purcell et al. ..... 52/309.9
5,884,435 A * 3/1999 David et al. ..... 52/62
5,918,437 A * 7/1999 Dobija ..... 52/506.01
6,189,273 B1 * 2/2001 Larson ..... 52/255
6,298,609 B1 * 10/2001 Bifano et al. ..... 52/58
6,311,442 B1 * 11/2001 Watanabe ..... 52/282.3
6,341,458 B1 * 1/2002 Burt ..... 52/287.1
6,591,559 B2 * 7/2003 Contreras et al. ..... 52/101
6,786,011 B2 * 9/2004 Mares ..... 52/62
7,546,719 B1 * 6/2009 Guevara ..... 52/716.2
7,634,883 B1 * 12/2009 Larson et al. ..... 52/573.1

(Continued)

FOREIGN PATENT DOCUMENTS

EP 4459 A2 * 10/1979 ..... E04B 1/60
GB 2155076 A * 9/1985 ..... E04B 1/64
JP 01187248 A * 7/1989 ..... E04F 13/08

*Primary Examiner* — Adriana Figueroa

(74) *Attorney, Agent, or Firm* — Miller Thomson LLP; Tai W. Nahm

(57) ABSTRACT

There is disclosed an improved wall panel trim reveal system and method which utilizes a set of vertical, horizontal and corner trim pieces designed to be fitted together. In an embodiment, the system includes horizontal trim pieces having at least one slope, vertical trim pieces having at least one tab forming a slot for receiving one or more horizontal trim pieces therein, wherein the horizontal and vertical trim pieces when installed together with wall panels forming a moisture drainage channel to direct moisture away from the wall.

19 Claims, 13 Drawing Sheets

(56) References Cited

U.S. PATENT DOCUMENTS

| | | | | |
|---|---|---|---|---|
| 7,673,421 | B2 * | 3/2010 | Pilz | 52/60 |
| 7,743,575 | B2 * | 6/2010 | Ito | 52/582.1 |
| 7,784,222 | B2 * | 8/2010 | Bennett | 52/58 |
| 8,046,956 | B1 * | 11/2011 | Hohmann, Jr. | 52/62 |
| 8,082,713 | B2 * | 12/2011 | Matthews | 52/371 |
| 8,347,567 | B2 * | 1/2013 | Nolan et al. | 52/213 |
| 8,484,931 | B2 * | 7/2013 | Gleeson et al. | 52/747.1 |
| 8,584,416 | B2 * | 11/2013 | Chenier et al. | 52/393 |
| 2009/0183453 | A1 * | 7/2009 | Koessler et al. | 52/302.3 |
| 2010/0212234 | A1 * | 8/2010 | Monteer | 52/95 |

* cited by examiner

500

510

520

WALL PANEL TRIM REVEAL SYSTEM AND METHOD

CROSS REFERENCE TO RELATED APPLICATIONS

This application claims the benefit of U.S. Provisional Patent Application Ser. No. 61/474,135 filed on Apr. 11, 2011, and entitled WALL PANEL TRIM REVEAL SYSTEM AND METHOD, the entirety of which is incorporated by reference herein.

FIELD

The present disclosure relates to an improved wall panel trim reveal system and method, and more particularly to a trim reveal system and method for cladding the exterior of buildings with wall panels.

BACKGROUND

Wall panel trim systems and methods for installing wall panels are a relatively economic way of cladding the surfaces of buildings. However, prior wall panel trim systems and methods often require significant time and skill to install, as the trim pieces may need to be cut to fine tolerances in order to avoid unsightly gaps and to avoid sharp edges. In addition, prior wall panel trim systems and methods may not allow for proper moisture control, making wall panels vulnerable to premature wear and moisture damage when used for exterior applications.

What is needed is an improved wall panel trim reveal system and method for cladding the exterior of buildings with exterior wall panels which overcomes at least some of the drawbacks and limitations as described above.

SUMMARY

The present disclosure relates to an improved wall panel trim reveal system and method which utilizes a set of vertical, horizontal and corner trim pieces designed to be fitted together. In an embodiment, the horizontal pieces are sized and configured to be received within slots or tabs formed in the vertical trim pieces. As will be explained in more detail, this allows for a relaxation of tolerances in cutting the lengths of the horizontal pieces, as there is significant overlap of the tabs formed in the vertical trim pieces over the edge of the horizontal pieces.

In addition, the configuration of the installed horizontal, vertical and corner trim pieces forms a moisture drainage channel which directs moisture away from the walls of a building. Therefore, the present panel trim reveal system and method is particularly suitable for use with wall panels for exteriors, such as fiber cement panels and the like, for cladding the exterior of buildings in a fast, simple and inexpensive manner.

In the present disclosure, the term "reveal" or "reveals" refers to portions of the trim pieces that are visible after installation in order to provide a visually appealing architectural detail between the wall panels.

In an embodiment, the present wall panel trim reveal system includes a plurality of primary profiles and a plurality of alternate profiles for corner trims, vertical trims and horizontal trims, at least some of which are interchangeable, to ensure a uniform installation and trim reveal with many standard wall panels. The trim pieces may be provided in various standard lengths (e.g. ten foot lengths) that may be cut down to size as needed, or butted against one another in order to obtain longer trim lengths as may be needed. This standard length is illustrative, and it will be appreciated that the trim pieces may be cut to any other specified length as may be necessary.

In an embodiment, the trim pieces may be made from extruded metals, such as aluminum or aluminum alloys. The trim pieces may further include functional and/or visually appealing details, such as grooves cut into the profile, which may remain in view after installation. The trim pieces may also include other visually appealing finishes, such as various metallic colors achieved by utilizing an aluminum anodizing process. Various other means may be used to increase the visual appeal of the trim pieces including the use of paints and texturing, as may be desired.

In an embodiment, as an illustrative example, all trim pieces may have half inch tabs and/or half inch center reveals in order to provide a consistent appearance for all trim pieces within the system. It will be appreciated, however, that any other measurement may be used for the tabs and/or reveals to provide a visually attractive trim.

The result is a fast and affordable wall panel trim reveal system and method which improves upon certain limitations and drawbacks found in prior designs.

DETAILED DESCRIPTION

As noted above, the present disclosure relates to an improved wall panel trim reveal system and method. More particularly the present disclosure relates to a trim reveal system including corner trims, vertical trims and horizontal trims for cladding the walls of buildings with wall panels. Various illustrative embodiments will now be described with reference to the drawings.

Now referring to FIGS. 1A-1D, shown are cross-sectional views 100, 110, 120, 130 of various vertical corner and edge trim pieces in accordance with various embodiments.

Figure 1A:
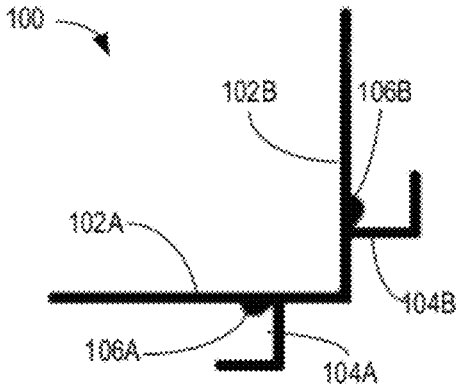
FIGS. 1A-1D show cross-sectional views of various vertical corner and edge trim pieces in accordance with various embodiments.

As shown in FIG. 1A, a square outside corner trim piece 100 includes mounting walls 102A, 102B substantially perpendicular to each other for installation of the trim piece at an outside corner of a building. Square outside corner trim piece 100 further includes tabs 104A, 104B attached on outer sides of mounting walls 102A, 102B and forming slots for receiving an edge of a horizontal trim piece. Square outside corner trim piece 100 further includes bumps 106A, 106B formed near the inside corners at which tabs 104A, 104B are attached to the outer sides of walls 102A, 102B. Portions of square outside corner trim piece 100 including tabs 104A, 104B are reveals which remain visible after installation.

With this configuration, horizontal trim pieces nest inside the slots formed by tabs 104A, 104B, and any wall panels (not shown) are kept close to tabs 104A, 104B by bumps 106A, 106B. As will be explained in further detail below, this creates an interior moisture drainage channel down the entire length of one or more square outside corner trim pieces 100 installed at an outside corner of a building.

Figure 1B:
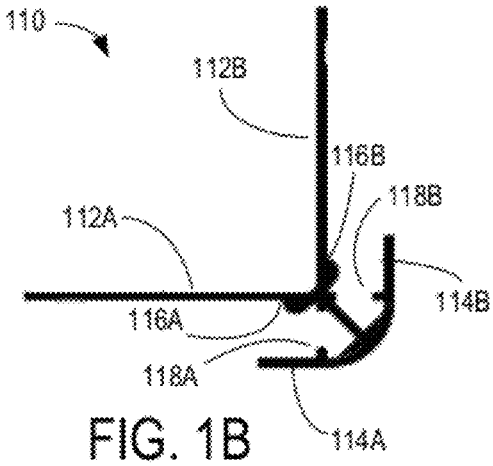

Now referring to FIG. 1B, an alternate round outside corner trim piece 110 is shown having mounting walls 112A, 112B substantially perpendicular to each other and a rounded corner piece attached at the corner of mounting walls 112A, 112B and with tabs 114A, 114B forming slots for receiving edges of horizontal trim pieces therein. Thus, round outside corner trim piece 110 comprises two tabs formed from a double-sided rounded corner edge forming two slots, such that the two tabs and the rounded corner edge form the appearance of a continuous rounded corner.

Bumps 116A, 116B formed near the inside corners at which tabs 114A, 114B are attached to mounting walls 112A, 112B serve the same functions as bumps 106A, 106B described for FIG. 1A above. In addition, round outside corner trim piece 110 includes stop flanges 118A, 118B to serve as a stop for edges of horizontal trim pieces received therein. The bumps 116A, 116B keep any wall panels (not shown) close to tabs 114A, 114B and create an interior drainage channel within rounded outside corner trim piece 110. Portions of rounded corner trim piece 110 including a rounded outside corner and tabs 114A, 114B are reveals that remain visible after installation.

It will be appreciated that square outside corner trim piece 100 and rounded outside corner trim piece 110 may be interchangeable, depending on architectural preference. It will also be appreciated that various other corner profiles incorporating tabs and bumps may be designed in order to receive edges of horizontal trim pieces and to allow for visually attractive reveals which remain visible after installation.

Figure 1C:
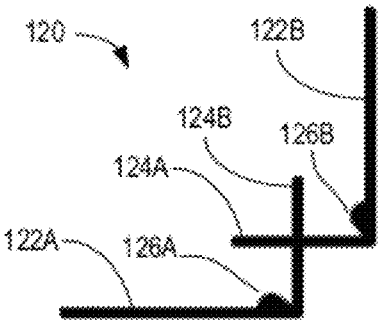

Now referring to FIG. 1C, shown is an inside corner trim piece 120 for installation at inside corners of buildings. Inside corner trim piece 120 has mounting walls 122A, 122B that are substantially perpendicular to each other, and include tabs 124A, 124B forming slots to receive edges of horizontal trim pieces. Bumps 126A, 126B formed near the inside corner where tabs 124A, 124B are connected to mounting walls 122A, 122B keep any wall panels (not shown) close to tabs 124A, 124B in order to form interior drainage channels to control moisture. As shown in FIG. 1C, the two tabs 124A, 124B and a corner formed by the mounting walls 122A, 122B therebetween together provide the appearance of a visually appealing triple corner at an outer corner of a building.

Figure 1D:
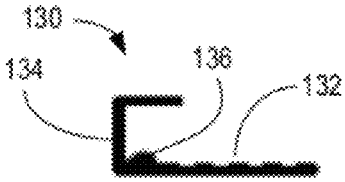

Now referring to FIG. 1D, shown is a vertical edge trim piece 130 that may be used to terminate a vertical edge. As shown, vertical edge trim piece 130 includes mounting wall 132, tab 134 forming a slot to receive an edge of a horizontal trim piece, and bump 136. Bump 136 serves to keep any wall panels (not shown) close to tab 134.

Figure 1E:
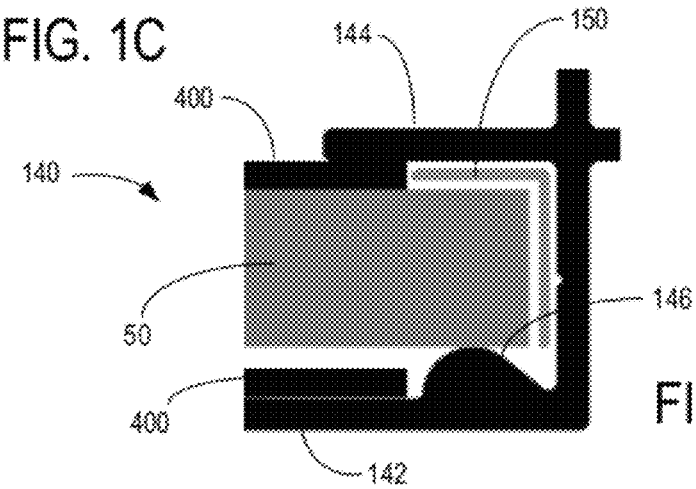
FIG. 1E shows a cross-sectional detailed view of a vertical trim piece interacting with a wall panel.

FIG. 1E is a cross-sectional detailed view of a vertical trim piece 140. As shown, vertical trim piece 140 includes mounting wall 142 and tab 144 forming a slot for receiving an edge of a horizontal trim piece 400. Bump 146 formed near an inside corner where tab 144 is connected to mounting wall 142 serves to keep wall panel 50 off of the building wall and closer to tab 144. Bump 146 also forms a moisture drainage channel within vertical trim piece 140, allowing moisture 150 to drain down the length of vertical trim piece 140 and away from the building wall.

Figure 2A:
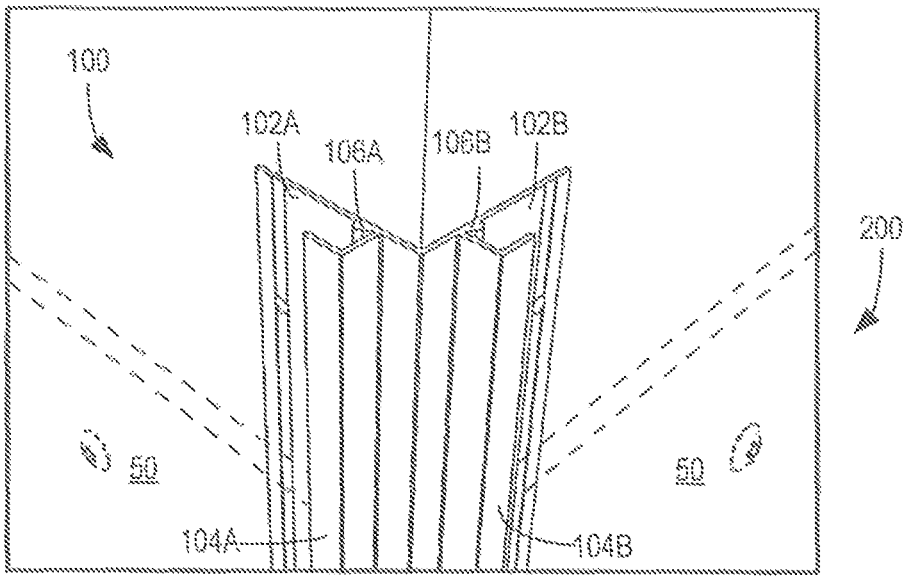
FIGS. 2A and 2B show perspective views of the trim pieces of FIGS. 1A and 1B with wall panels.
Figure 2B:
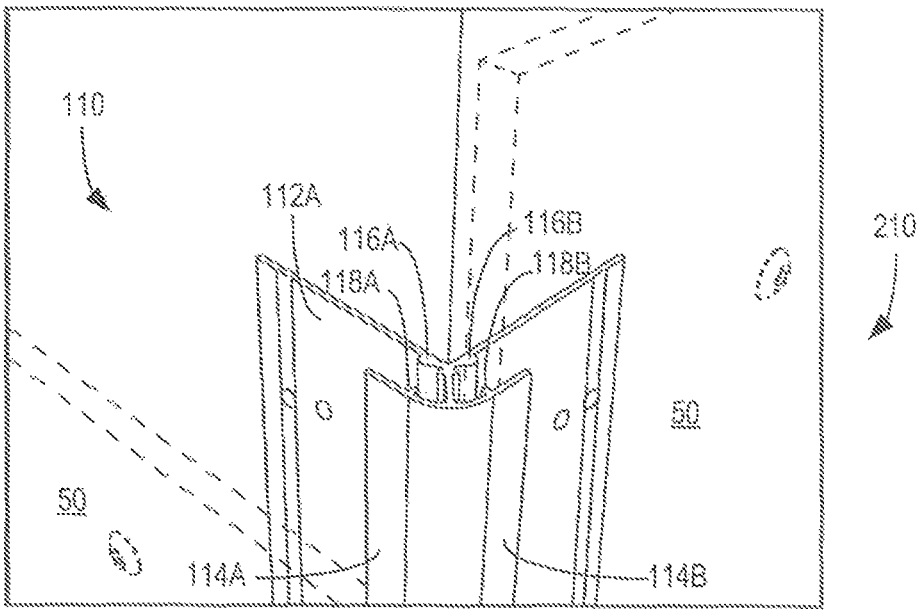

Now referring to FIGS. 2A and 2B, shown are perspective views 200, 210 of the trim pieces of FIGS. 1A and 1B together with wall panels. As shown, FIG. 2A illustrates square outside corner trim piece 100 with mounting walls 102A, 102B mounted to a corner of a building. Tabs 104A, 104B form slots to receive edges of wall panes 50, and as earlier illustrated, bumps 106A, 106B keep wall panels 50 away from the building wall and close to tabs 104A, 104B. Similarly, FIG. 2B illustrates round outside cornier trim piece 110 with mounting walls 112A, 112B mounted to a corner of a building. Tabs 114A, 114B form slots to receive wall panels 50 therein. Bumps 116A, 116B keep wall panels 50 away from the building wall and close to tabs 114A, 114B.

Figure 3A:
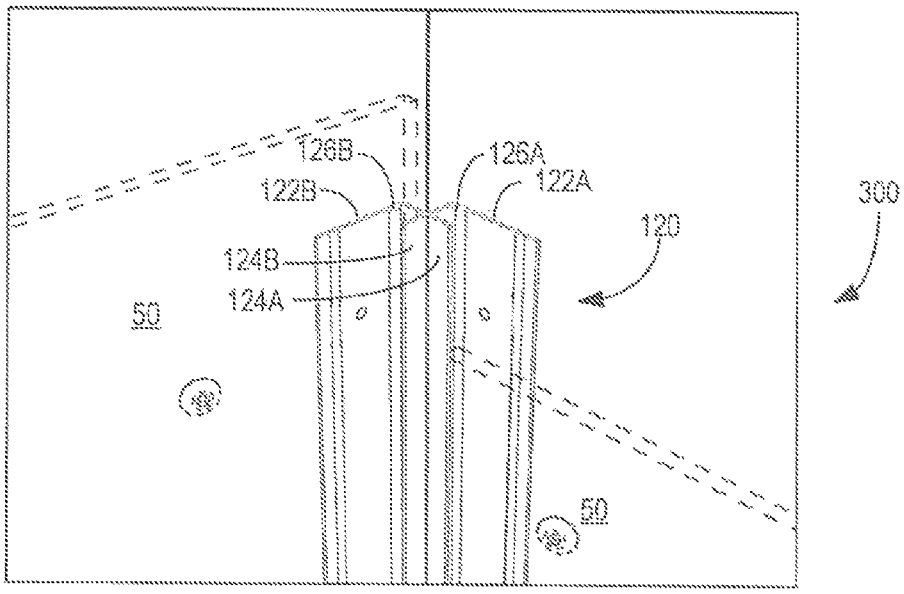
FIGS. 3A and 3B show perspective views of the trim pieces of FIGS. 1C and 1D with wall panels.
Figure 3B:
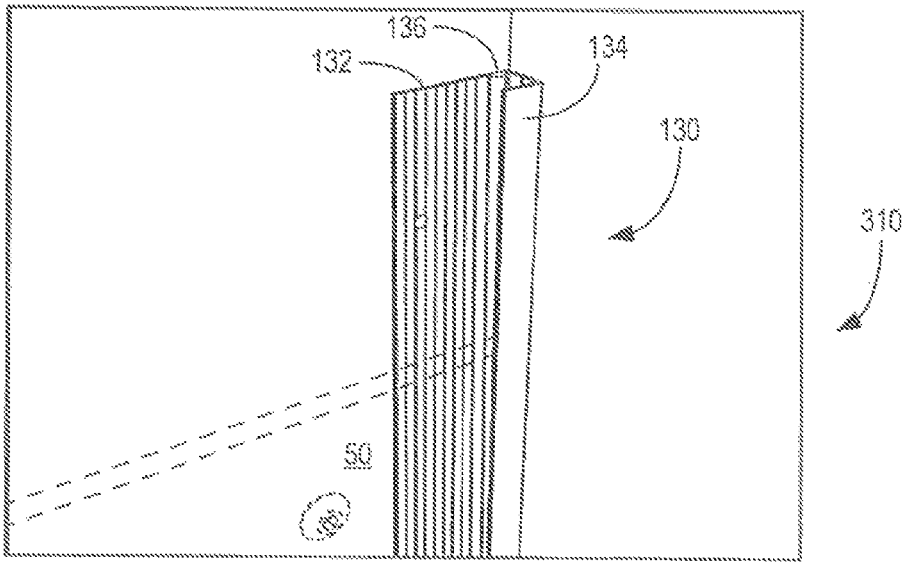

FIGS. 3A and 3B show perspective views 300, 310 of the trim pieces of FIGS. 1C and 1D together with wall panels. As shown in FIG. 3A, inside corner trim piece 120 is mounted to an inside corner of a building by mounting walls 122A, 122B. Tabs 124A, 124B receive edges of wall panels 50 and bumps 126A, 126B keep wall panels 50 away from the building wall and close to tabs 124A, 124B. FIG. 3B shows vertical edge piece 130 mounted by wall 132. Tab 134 receives an edge of wall panel 50, and bump 136 keeps wall panel 50 away from the building wall and close to tab 134.

Figure 4A:
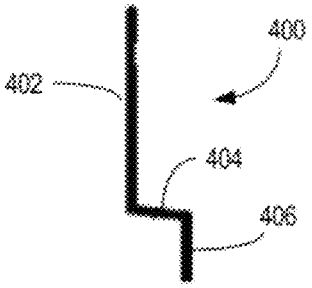
FIGS. 4A-4D show cross-sectional views of various horizontal trim pieces in accordance with various embodiments.

FIGS. 4A-4D show cross-sectional views of various horizontal trim pieces in accordance with various embodiments. For example, FIG. 4A shows a single slope horizontal trim piece 400 having mounting wall 402, a slope 404, and a horizontal reveal 406. Horizontal trim piece 400 may be used as a base horizontal trim, and also be used above frames for windows and doors. As noted earlier, single slope horizontal trim piece 400 is sized and shaped to fit within a slot formed in any corner piece or vertical edge piece described above with reference to FIGS. 1A-3B.

All horizontal trim pieces 400, 410, 420, 430 described with respect to FIGS. 4A-4D are sized and shaped to be received in slots formed in any corner trim or vertical edge trim pieces described above, and to butt up against bumps formed in the corner trim or vertical edge trim pieces. No cuts have to be exactly precise because the reveals of the vertical trims allow for some tolerance in the cut lengths of the horizontal trim pieces to fit into and be visually covered by the tabs in the vertical trim pieces. This fit and finish aspect of the tabs in the vertical trim pieces also removes any sharp cut edges to be visible and avoids safety hazards as the sharp cut edges slide into the vertical trim profiles.

Figure 4B:
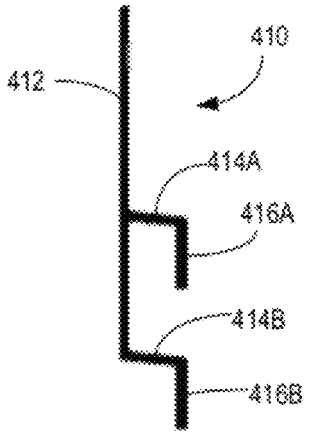

FIG. 4B shows a double slope horizontal trim piece 410 having a mounting wall 412, slopes 414A, 414B, and two horizontal reveals 416A, 416B. An outer portion of mounting wall 412 between reveals 416A, 416B is also visible after installation. The two horizontal reveals 416A, 416B and center reveal (i.e. the outer portion of mounting wall 412 visible between the two horizontal reveals 414A, 414B match the visual appearance of vertical trim pieces to be described with respect to FIGS. 6A-6C below, without trapping any moisture between the two horizontal reveals 414A, 414B.

It is believed by the inventor that the profile shown in FIG. 4B did not previously exist in the exterior trim market. Commonly, installers will use a Z trim profile in combination with a vertical H trim. The overall design is not consistent, as the horizontal trim is a single tab with no center reveal and the vertical trim has two tabs with a center reveal. A J trim and a H trim cannot be used horizontally as they trap water, snow, ice and moisture and this compromises the performance of the set in panel and the building envelope.

Figure 4C:
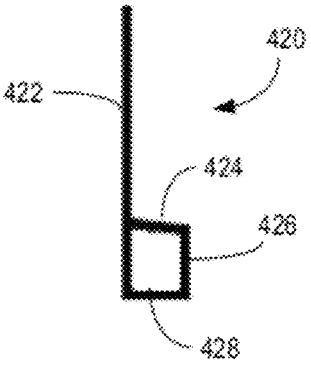

FIG. 4C shows a modified horizontal trim piece 420 having a wall 422, slope 424, a horizontal reveal 426 and an underside reveal 428 which may be visible from below after installation. Thus, this trim piece is suitable for locations higher up on the walls of buildings which are visible to people from below.

Figure 4D:
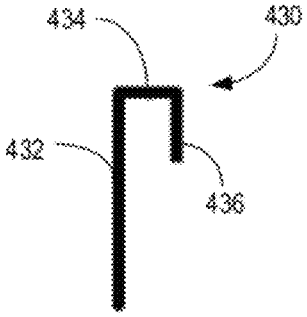

Now referring to FIG. 4D, shown is a top horizontal trim piece 430 for use in trimming the tops of wall panels. Top horizontal trim piece 430 includes mounting wall 432, tab 434, and horizontal reveal 436. As will be appreciated, when wall panels 50 are installed vertically, Top horizontal trim piece 430 may abut one or more of horizontal trim pieces 400, 410 and 420.

Figure 4E:
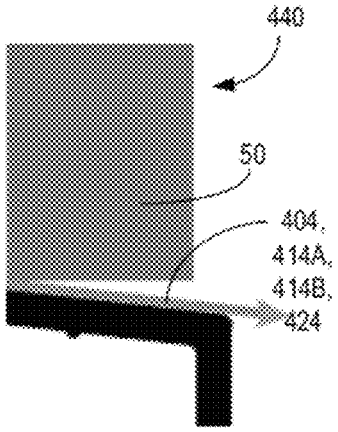
FIG. 4E shows a cross-sectional detailed view of the horizontal trim pieces of FIGS. 4A-4C with a sloped ledge interacting with a wall panel.

Now referring to FIG. 4E, shown is a cross-sectional detailed view of the horizontal trim pieces of FIGS. 4A-4C with slopes 404, 414A, 414B, 424 interacting with a wall panel 50. As shown, a slight gap is formed between wall panel 50 and slopes 404, 414A, 414B, 424, whereby any moisture from behind wall panel 50 may escape and drain away from the building and the trim.

Currently, horizontal trims available on the market are designed with a 90 degree angle. This does not drain water away from the building and may in fact hold water and contribute to snow and ice buildup. After experimentation, the inventor has determined that a downward slope of approximately 3 degrees to 10 degrees from horizontal is preferable, although even greater angles are possible. More preferably, a slope of between 5 degrees and 8 degrees may be used for the sloped portions of the horizontal trim pieces of FIGS. 4A-4C. In a preferred embodiment, a 6.6 degree slope may be used for all slopes in the horizontal trim pieces.

Figure 5A:
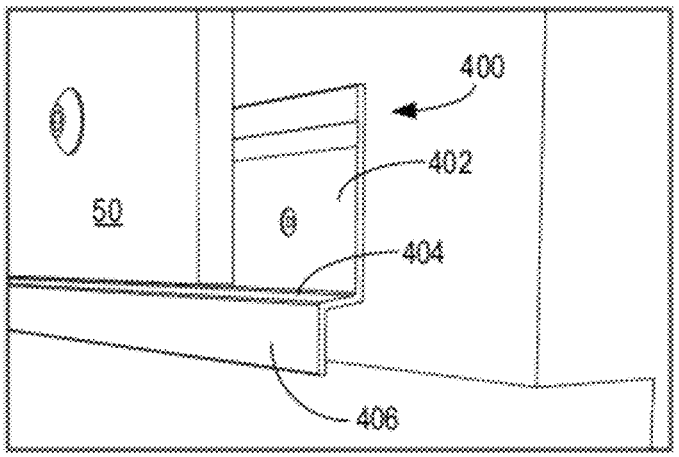
FIGS. 5A-5C show perspective views of the horizontal trim pieces of FIGS. 4A-4C with wall panels.
Figure 5B:
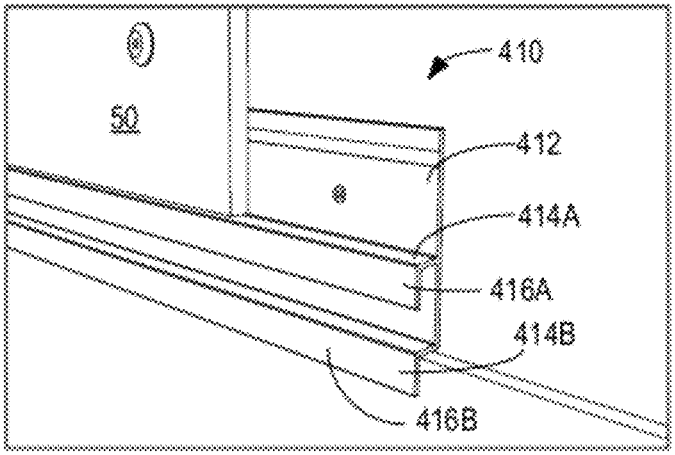
Figure 5C:
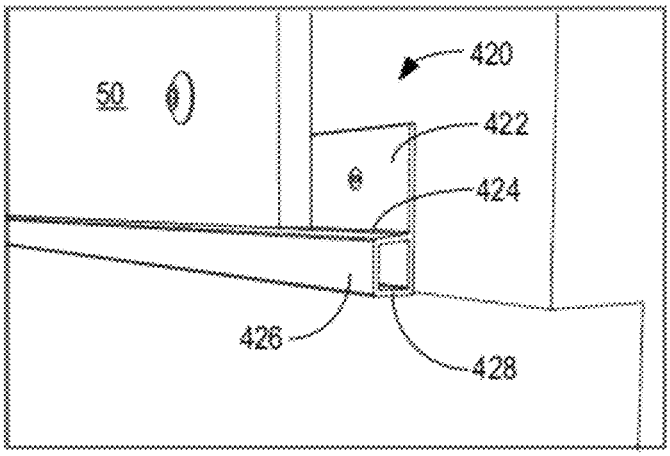

Now referring to FIGS. 5A-5C, shown are perspective views of the horizontal trim pieces of FIGS. 4A-4C interacting with wall panels. As shown in FIG. 5A, single slope horizontal trim piece 400 may be mounted by mounting wall 402, and slope 404 may be near the bottom of wall panel 50. Horizontal reveal 406 remains visible after installation of wall panel 50. As wall panel 50 is mounted to the wall as well by suitable fasteners, it is important to note that the horizontal trim pieces need not be load bearing. Therefore, as noted, slope 404 may be set at an angle greater than 10 degrees if desired, as slope 404 does not need to bear the weight of wall panel 50.

Now referring to FIG. 5B, shown is a double slope horizontal trim piece 410 mounted by mounting wall 412. Slope 414A is near the bottom of wall panel 50, but as noted, slope 414A does not bear the load of wall panel 50, which is mounted independently to the building wall. As shown, horizontal reveals 416A, 416B, slope 414B and the outer side of mounting wall 412 between horizontal reveals 416A, 416B are all visible after installation of double slope horizontal trim piece 410.

Now referring to FIG. 5C, shown is an alternate single slope horizontal trim piece 420 mounted by mounting wall 422, where slope 424 is abutting the bottom of wall panel 50. Once again, slope 424 does not bear the load of wall panel 50, and therefore may be sloped beyond 10 degrees if desired. Horizontal reveal 426 and underside reveal 428 may remain visible after installation.

As noted earlier, in the vertical trim pieces, the bumps (e.g. bumps 106A, 106B of FIG. 1A) are positioned near the inside corners of where tabs (e.g. tabs 104A, 104B of FIG. 1A) are connected to the mounting walls (e.g. mounting walls 102A, 102B of FIG. 1A). As best shown in FIG. 1E, in one embodiment, theses bumps are shaped as a tear drop to act as a moisture barrier and create a moisture drainage path within the trim assembly. Water is commonly driven by wind and driving rain into the corners of buildings, and the bumps allow the water that is driven into these corners to be contained in the corner of the trims and run down the moisture drainage channel formed by these bumps. The bumps also space the wall panel off of the water drainage area so that the panel edge does not remain in direct contact with the moisture within the covered trim tabs.

Prior reveal trim products available to the market do not have any drainage elements incorporated into their design because most extruded aluminum reveal products have been designed for interior use. Thus, wall panels sitting in these prior are always in contact with areas of water collection, possibly compromising the long term performance of the set in panels and paint finish.

In contrast, the horizontal and vertical trim pieces of the present disclosure are designed to drain water away from the building walls by incorporating slopes in horizontal trim pieces (e.g. FIGS. 4A-4C) and moisture drainage channels created by placement of bumps near inside corners of the vertical trim pieces. Together, these unique details allow water, snow, ice, and moisture to freely drain away from the wall panels and building envelope.

Figure 6A:
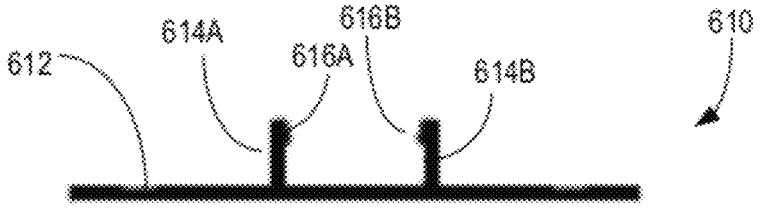
FIGS. 6A-6C show cross-sectional views of various vertical trim pieces with interlocking protrusions.
Figure 6B:
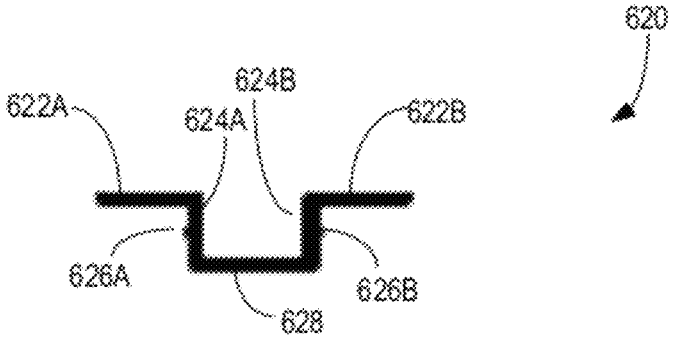
Figure 6C:
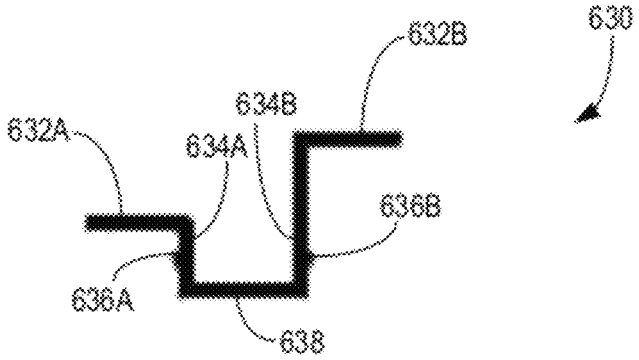

Now referring to FIGS. 6A-6C, shown are cross-sectional views of various vertical trim pieces with interlocking protrusions. As shown in FIG. 6A, vertical back plate 610 includes a mounting wall 612 for mounting, and two side walls 614A, 614B forming a channel. On the inner side of side walls 614A, 614B are locking protrusions 616A, 616B for locking engagement with corresponding locking protrusions 626A, 626B (FIG. 6B) found on a matching vertical top cap trim piece 620. Vertical top cap trim piece 620 includes vertical reveals 622A, 622B, a recessed vertical reveal 628 and matching profile side walls 624A, 624B to be received in the channel of vertical back plate 610.

While not shown, vertical back plate 610 may include bumps similar to the bumps found in the other trim pieces (e.g. bumps 106A, 106B of FIG. 1A), although such bumps may be made smaller to keep the wall panels at an appropriate position.

FIG. 6C shows an alternate vertical top cap trim piece 630 having a recessed vertical reveal 638 and offset vertical reveals 632A, 632B for accommodating wall panels with different thicknesses. In this case, vertical top cap trim piece 630 has locking protrusions 636A, 636B located at the same positions, but the profile side walls 636A, 636B are sized differently. This may be used when transitioning from one type of wall panel to another type of wall siding having a different thickness.

Figure 7A:
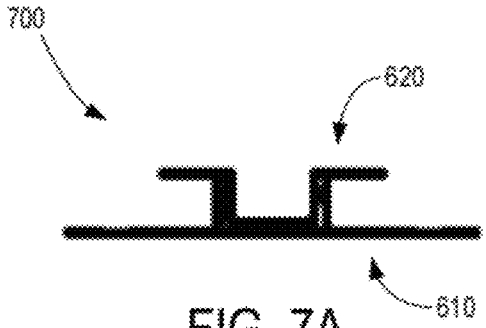
FIGS. 7A and 7B shows the vertical trim pieces of FIGS. 6A-6C in an interlocked position.
Figure 7B:
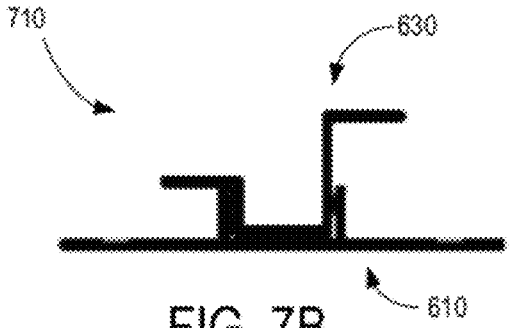
Figure 7C:
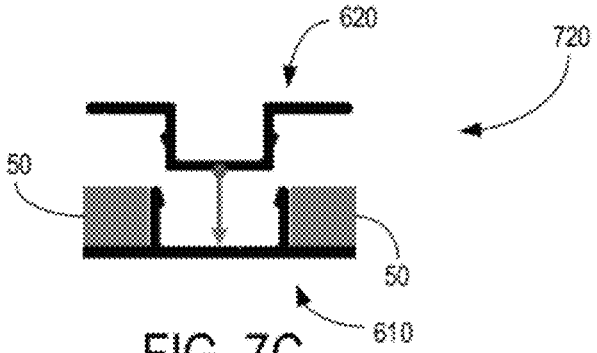
FIGS. 7C and 7D show the vertical trim pieces of FIGS. 6A and 6B being interlocked with wall panels placed therebetween.
Figure 7D:
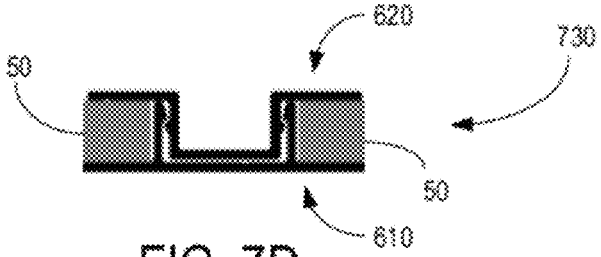

FIGS. 7A and 7B show, in illustrations 700 and 710, the pieces of FIGS. 6A-6C in interlocked positions to illustrate the differences between vertical top cap trim pieces 620 and 630. FIGS. 7C and 7D show in more detail the vertical trim pieces of FIGS. 6A and 6B being interlocked together with wall panels 50 received therebetween. In use, vertical top cap trim piece 620 may be pushed into locking position within vertical back plate 610 using a rubber mallet, or some similar tool.

Figure 8A:
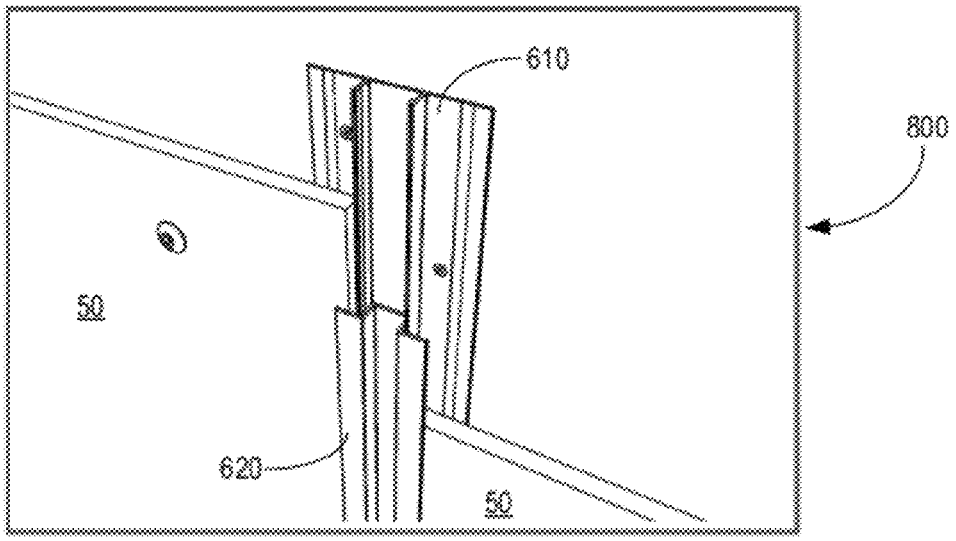
FIGS. 8A and 8B show perspective views of the interlocked vertical trim pieces of FIGS. 7A and 7B with wall panels.
Figure 8B:
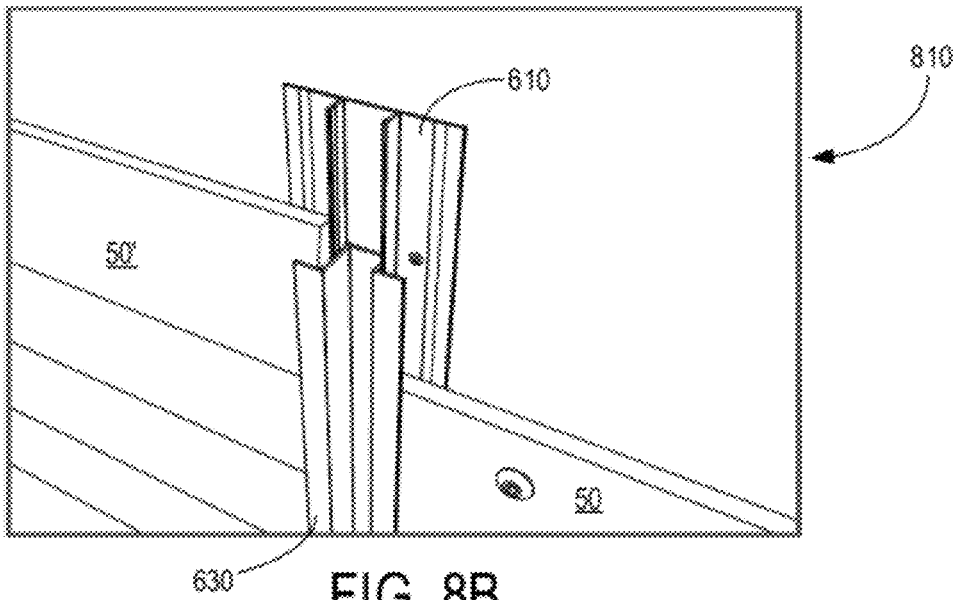

Now referring to FIGS. 8A and 8B, shown are some perspective views 800, 810 of the interlocked vertical trim pieces of FIGS. 7A and 7B with wall panels. FIG. 8A shows vertical top cap trim piece 620 used to trim two wall panels 50 separated by vertical back plate 610. Advantageously, as vertical top cap trim piece 620 may be installed simply by tapping into place using a rubber mallet or some similar tool, installation is very quick, without the need for fasteners. Advantageously, this snap locking system significantly increases the efficiency of installation of these vertical trim pieces, and is a significant improvement over one piece H trim pieces where installers often have to fight to set a panel under the trim reveal tabs when the area is too small to allow wall panels to be set in place comfortably.

In an embodiment, the present snap locking system also acts as a moisture management system when used with horizontal trim profiles described earlier. The vertical back plate 610 butts up to a nailing flange of a horizontal trim piece, and then the vertical top cap trim piece 620 is locked in place. The vertical top cap trim piece 620 then slides down over the nailing flange of a horizontal back plate located on the bottom edge of the siding panel creating a shingled wall assembly and positive lap for water to shed down and away from the building envelope. On the top edge of a wall panel, the vertical top cap trim piece 620 once locked in place fits under the bottom tab of single or double slope horizontal trim pieces 400, 410 again to create a shingled positive lapped installation.

Figure 9A:
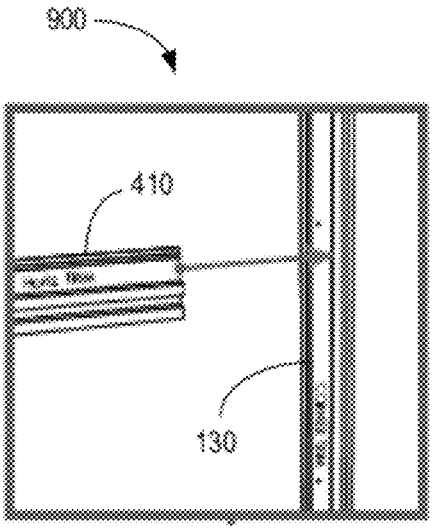
FIGS. 9A and 9B show illustrative perspective views of an edge of a horizontal trim piece being received within a groove or channel formed by a tab of a vertical trim piece.
Figure 9B:
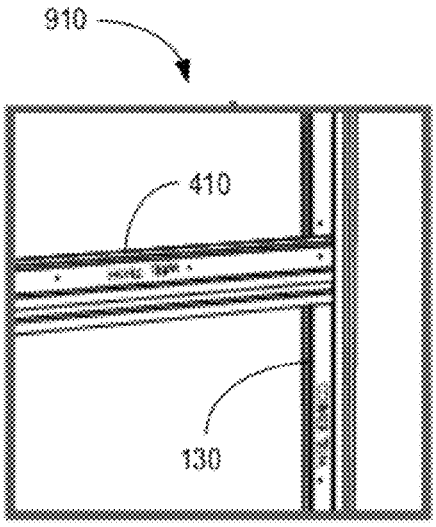
Figure 9C:
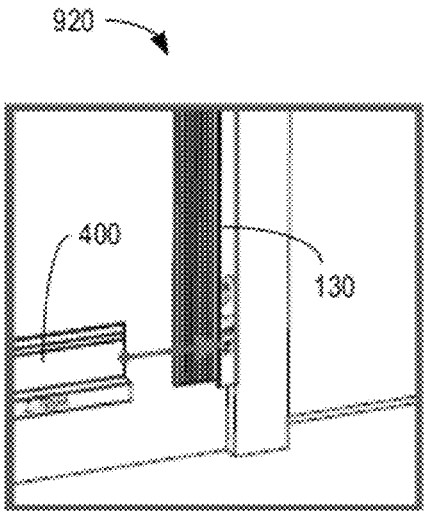
FIGS. 9C and 9D show illustrative perspective views of an edge of another horizontal trim piece being received within a groove or channel formed by a tab of another vertical trim piece.
Figure 9D:
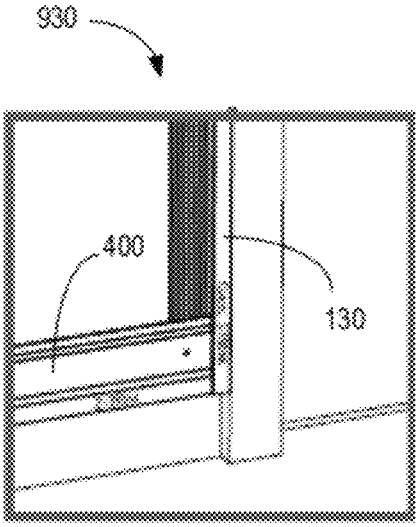

FIGS. 9A and 9B show illustrative perspective views of an edge of a double slope horizontal trim piece 410 being inserted into a slot formed by a tab of a vertical edge piece 130. Similarly, FIGS. 9C and 9D show illustrative perspective views of an edge of a single slope horizontal trim piece 400 being received within a slot of a vertical edge trim piece 130.

Figure 10A:
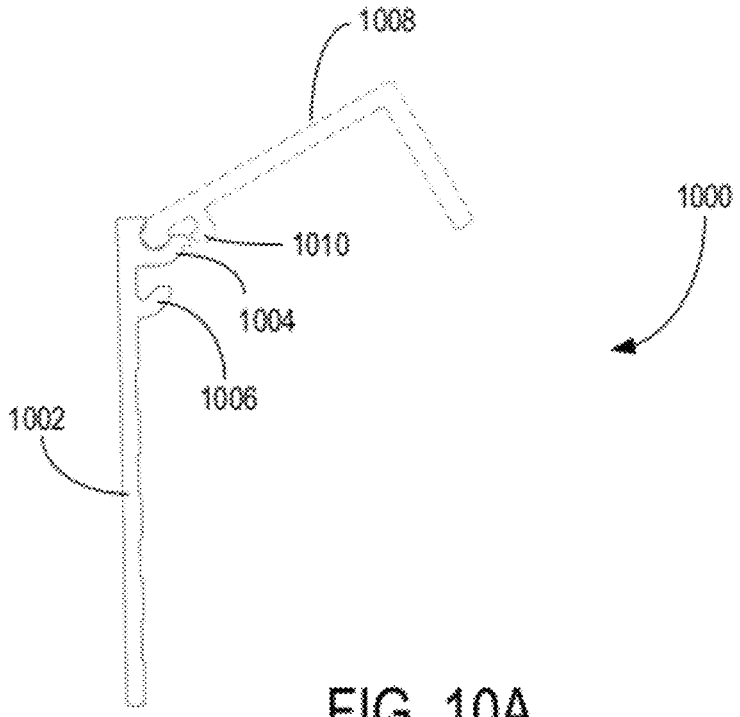
FIGS. 10A and 10B show cross-sectional views of vertical trim pieces with rotatable tabs in accordance with another embodiment.
Figure 10B:
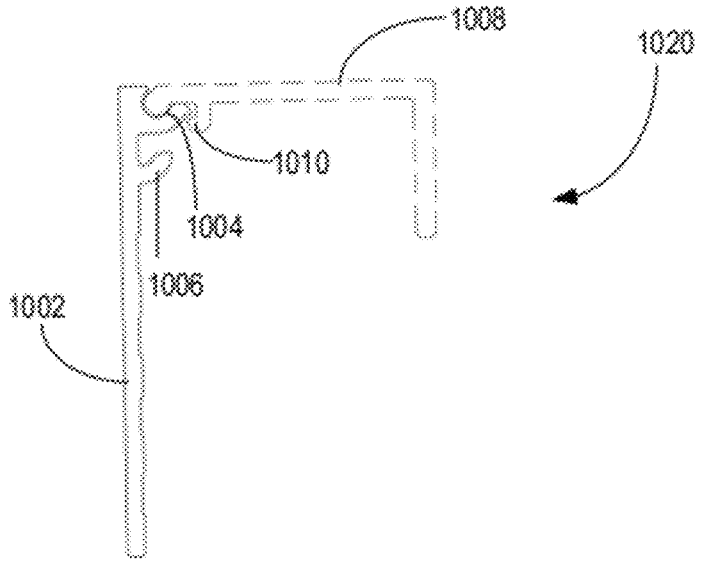

Now referring to FIGS. 10A and 10B, shown are cross-sectional views of vertical trim pieces with rotatable tabs in accordance with another embodiment. As shown, vertical trim piece 1000 includes a mounting wall 1002 with hinge 1004 and bump 1006. Hinge 1004 is configured to rotatably receive tab 1008. Tab 1008 includes a complementary lock 1010. As shown by vertical trim piece 1020 in FIG. 10B, when tab 1008 is rotated into position, lock 1010 rotates about hinge 1004 and snaps into position by using locking elements provided on hinge 1004 and lock 1010.

Figure 11A:
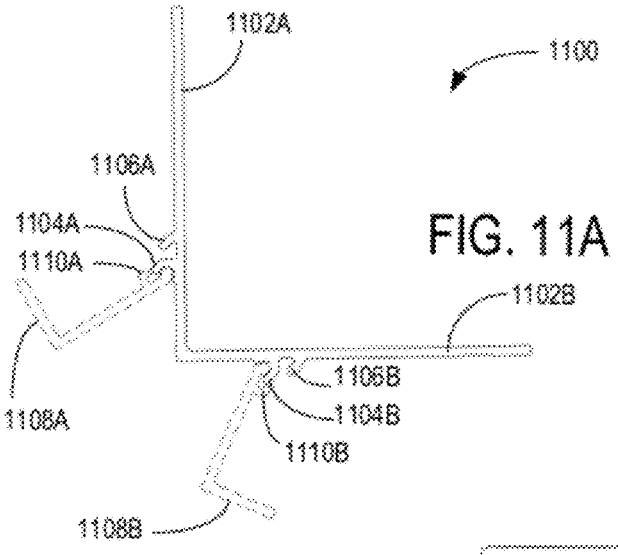
FIGS. 11A and 11B show cross-sectional views of vertical corner trim pieces with the rotatable tabs of FIGS. 10A and 10B.
Figure 11C:
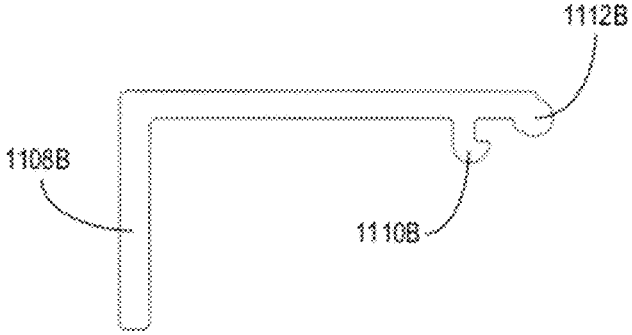
FIG. 11C shows a detailed cross-sectional view of a rotatable tab with a hinge having a non-circular shape.
Figure 11B:
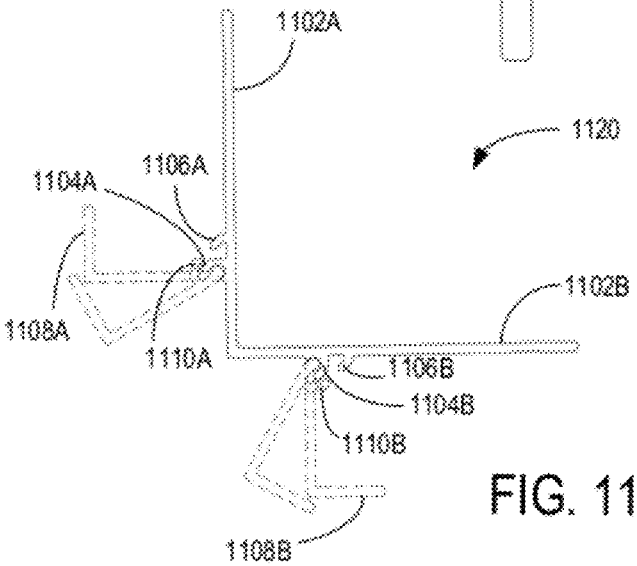

Now referring to FIGS. 11A and 11B, shown are cross-sectional views of vertical corner trim pieces with the rotatable tabs of FIGS. 10A and 10B. As shown, vertical corner trim piece 1100 includes mounting walls 1102A, 1102B with hinge sockets 1104A, 1104B located on outer sides of the mounting walls 1102A, 1102B.

Bumps 1106A, 1106B perform a function analogous to the bumps described earlier for other vertical trim pieces. However, bumps 1106A, 1106B may have a modified shape, wherein the slope to right side of the tear drop shaped bump of FIG. 1E has been carved out to form a slight hook or C-shape. The modified profile of bumps 1106A, 1106B acts as a moisture barrier and the hook or C-shape forms a moisture drainage channel within the vertical corner trim piece 1100.

Rotatable tabs 1108A, 1108B are rotatably hinged to walls 1102A, 1102B at hinge sockets 1104A, 1104B, and further include locks 1110A, 1110B for locking tables 1108A, 1108B into position, as shown by vertical corner trim piece 1120 in FIG. 11B. When tabs 1108A, 1108B are locked into position, the profile of vertical corner trim piece 1100 is similar to the profile of square outside corner trim piece 100 of FIG. 1A. However, it will be appreciated that the rotating tables 1108A, 1108B provide additional flexibility during wall panel installation.

Now referring to FIG. 11C, shown is a detailed cross-sectional view of rotatable tab 1108B. More particularly, rotatable tab 1108B includes a non-circular hinge ball 1112B that, when rotated within hinge socket 1104B progressively becomes harder to turn due to increasing mechanical friction, such that when lock 1110B is used to lock tab 1108B into position, tab 1108B is not slideable along its length within the hinge socket 1104B.

Figure 12A:
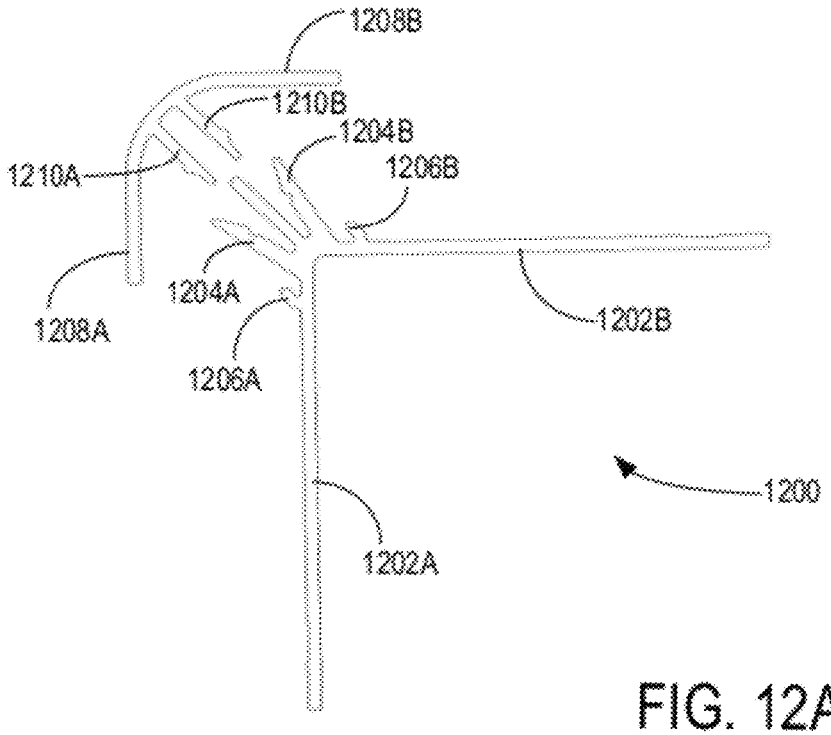
FIGS. 12A and 12B shows cross-sectional views of an alternative vertical corner trim piece with an interlocking tab.
Figure 12B:
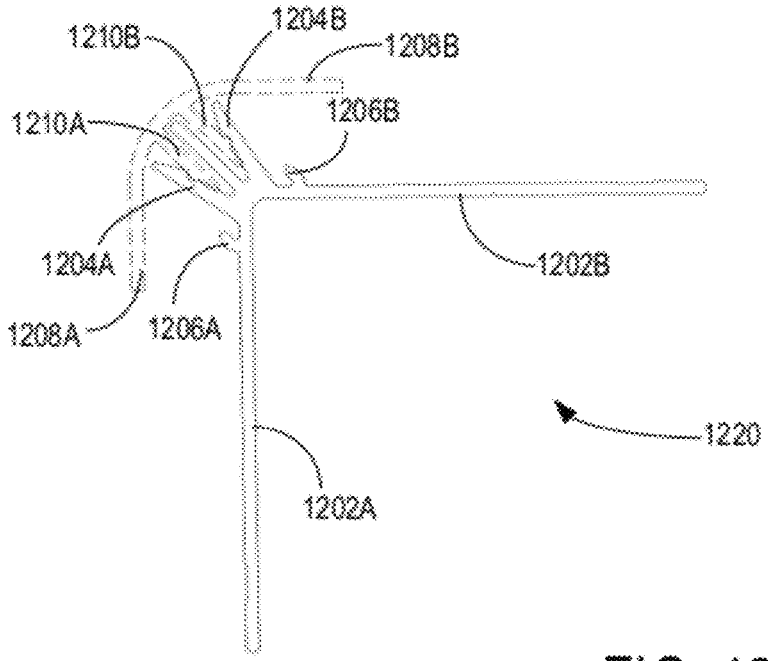

Now referring to FIGS. 12A and 12B, shown are cross-sectional views 1200 and 1220 of an alternative vertical corner trim piece with an interlocking tab. As shown in FIG. 12A, in this embodiment, the vertical corner trim piece includes mounting walls 1202A, 1202B, tab receiving arms 1204A, 1204B, bumps 1206A, 1206B, tabs 128A, 1208B, and tab locking arms 1210A, 1210B. FIG. 12B shows another view in which the tabs 1208A, 1208B (shown in stippled outline for clarity) are interlocked in position by the cooperating tab receiving arms 1204A, 1204B and tab locking arms 1210A, 1210B. This alternative vertical corner trim piece allows additional flexibility in mounting wall panels together with the trims, particularly if the wall panel is the last one being inserted, and there is little room to insert the wall panel into the slot formed by the tabs.

Figure 13:
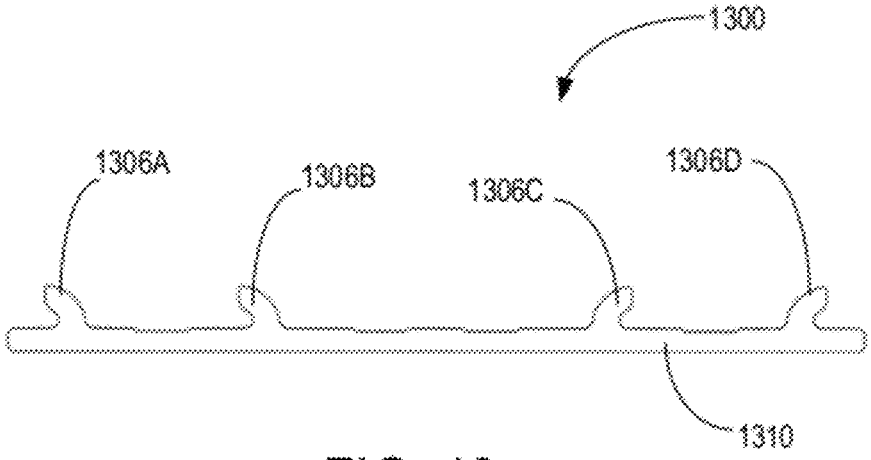
FIG. 13 shows a cross-sectional view of a vertical wall mount with bumps.

Now referring to FIG. 13, shown is a cross-sectional view 1300 of a mounting wall 1310 having a plurality of bumps 1306A-1306D for spacing a wall panel away from the building wall. Mounting wall 1310 may be used in conjunction with any of the trim pieces described above.

Thus, in an aspect, there is provided a wall panel trim reveal system for cladding a wall with wall panels, comprising: horizontal trim pieces having at least one slope; vertical trim pieces having at least one tab forming a slot for receiving one or more horizontal trim pieces therein; the horizontal and vertical trim pieces when installed together with wall panels forming a moisture drainage channel to direct moisture away from the walls.

In an embodiment, each vertical trim piece further comprises at least one mounting wall adapted for mounting the vertical trim piece to a wall, and at least one bump formed near an inside corner of the slot at which the at least one tab is attached to the mounting wall, the at least one bump forming a moisture drainage channel along each vertical trim piece.

In another embodiment, the at least one bump is adapted to abut an edge of the horizontal trim piece received within the slot, such that a moisture channel running along the length of each vertical trim piece is not obstructed by the horizontal trim piece.

In another embodiment, the at least one bump is adapted to abut any wall panels received within each vertical trim piece to keep the wall panels off the wall and close to the at least one tab.

In another embodiment, the at least one bump has a modified tear drop shape with a carve out one side forming a hooked shape, such that the hooked shape forms a moisture channel running along the length of each vertical trim piece.

In another embodiment, each corner vertical trim piece comprises perpendicular mounting walls and two tabs forming slots for receiving two horizontal trim pieces therein, each of the slots having at least one bump forming a moisture drainage channel within each tab running along each vertical trim piece.

In another embodiment, an outside corner vertical trim piece comprises two tabs and a corner edge therebetween, such that the two tabs and the corner edge form the appearance of a triple corner.

In another embodiment, an outside corner vertical trim piece comprises two tabs formed from a double-sided rounded corner edge forming two slots, such that the two tabs and the rounded corner edge form the appearance of a continuous rounded corner.

In another embodiment, each horizontal trim piece has a bottom ledge with a downward slope of between 3 degrees to 10 degrees from horizontal.

In another embodiment, each horizontal trim piece has a bottom ledge with a downward slope of between 5 degrees to 8 degrees from horizontal.

In another embodiment, each horizontal trim piece has a bottom ledge with a downward slope of 6.6 degrees from horizontal.

In another embodiment, the vertical trim pieces have at least one rotatable tab forming a slot for receiving one or more horizontal trim pieces therein.

In another embodiment, the at least one rotatable tab is rotatably hinged to mounting walls at a hinge socket, and further include locks for locking the tabs into position.

In another embodiment, the at least one rotatable tab is rotatably hinged to mounting walls at hinge sockets by a non-circular hinge ball that, when rotated within the hinge socket progressively locks the tab into position by increasing mechanical friction, thereby preventing the tab from sliding along its length within the hinge socket.

In another embodiment, wall panel trim reveal system further comprises a vertical top cap trim piece adapted to trim two wall panels separated by vertical back plate, the vertical top cap trim piece having locking protrusions adapted to interlock with corresponding locking protrusions in a channel formed in the vertical back plate.

In another embodiment, the vertical back plate includes at least one bump formed near a side wall forming the channel, the at least one bump forming a moisture drainage channel along the vertical back plate.

In another embodiment, the vertical back plate and vertical top cap trim piece are adapted to be interlocked by their locking protrusions without fasteners.

In another embodiment, the vertical top cap trim piece has offset vertical reveal tabs adapted to receive wall panels of different thicknesses.

While the above description provides examples of one or more systems and methods, it will be appreciated that other systems and methods may be within the scope of the present description as interpreted by one of skill in the art.

What is claimed is:

1. A wall panel trim reveal system for cladding a wall with non-overlapping wall panels, comprising:

one or more horizontal trim pieces having a bottom ledge adapted to support a bottom edge of a wall panel received thereon, the bottom ledge having a downward slope extending out to a horizontal reveal and adapted to extend out past the wall panel received thereon, the horizontal reveal having a substantially vertical flat surface;

one or more vertical trim pieces having at least one tab forming a slot for receiving one or more horizontal trim pieces therein, the at least one tab adapted to retain the substantially vertical flat surface of the horizontal reveal, wherein each vertical trim piece includes:

at least one mounting wall adapted for mounting the vertical trim piece to a building wall; and a bump attached to the at least one mounting wall and formed near an inside corner of the slot at which the at least one tab is attached to the mounting wall, the bump adapted to abut any wall panels received within the vertical trim piece to keep the wall panel off the building wall and to abut an edge of the one or more horizontal trim pieces received within the slot, such that a length of each vertical trim piece is not obstructed by the horizontal trim piece;

whereby the bump forms a moisture drainage channel along each vertical trim piece when the horizontal and vertical trim pieces are installed together with wall panels to direct moisture away from the building wall.

2. The wall panel trim reveal system of claim 1, wherein the bump is adapted to keep the wall panels off the wall and close to the at least one tab.

3. The wall panel trim reveal system of claim 1, wherein the bump has a hooked shape, such that the hooked shape forms a moisture channel running along each side of the bump along the length of each vertical trim piece.

4. The wall panel trim reveal system of claim 1, wherein the one or more vertical trim pieces comprises a corner vertical trim piece having perpendicular mounting walls and two tabs forming slots for receiving two horizontal trim pieces therein, each of the slots having a bump forming a moisture drainage channel within each tab running along each vertical trim piece.

5. The wall panel trim reveal system of claim 4, wherein the one or more vertical trim pieces comprises an outside corner vertical trim piece having two tabs and a corner edge there between, such that the two tabs and the corner edge form the appearance of a triple corner.

6. The wall panel trim reveal system of claim 4, wherein an outside corner vertical trim piece comprises two tables formed from a double-sided rounded corner edge forming two slots, such that the two tabs and the rounded corner edge form the appearance of a continuous rounded corner.

7. The wall panel trim reveal system of claim 1, wherein each horizontal trim piece has a bottom ledge with a downward slope of between 3 degrees to 10 degrees from horizontal.

8. The wall panel trim reveal system of claim 1, wherein each horizontal trim piece has a bottom ledge with a downward slope of between 5 degrees to 8 degrees from horizontal.

9. The wall panel trim reveal system of claim 1, wherein each horizontal trim piece has a bottom ledge with a downward slope of 6.6 degrees from horizontal.

10. The wall panel trim reveal system of claim 1, wherein the vertical trim pieces have at least one rotatable tab forming a slot for receiving one or more horizontal trim pieces therein.

11. The wall panel trim reveal system of claim 10, wherein the at least one rotatable tab is rotatably hinged to mounting walls at a hinge socket, and further include locks for locking the tabs into position.

12. The wall panel trim reveal system of claim 10, wherein the at least one rotatable tab is rotatably hinged to mounting walls at hinge sockets by a non-circular hinge ball that, when rotated within the hinge socket progressively locks the tab into position by increasing mechanical friction, thereby preventing the tab from sliding along its length within the hinge socket.

13. The wall panel trim reveal system of claim 1, further comprising a vertical top cap trim piece adapted to trim two wall panels separated by a vertical back plate, the vertical top cap trim piece having locking protrusions adapted to interlock with corresponding locking protrusions in a channel formed in the vertical back plate.

14. The wall panel trim reveal system of claim 13, wherein the vertical back plate and the vertical top cap trim piece are adapted to be interlocked by their locking protrusions without fasteners.

15. The wall panel trim reveal system of claim 13, wherein the vertical top cap trim piece has offset vertical reveal tabs adapted to receive wall panels of different thicknesses.

16. The wall panel trim reveal system of claim 1, wherein at least one of the one or more horizontal reveals extends downwardly and is adapted to cover a top of any wall panel installed below the at least one of the one or more horizontal reveals.

17. The wall panel trim reveal system of claim 16, wherein the at least one of the one or more horizontal reveals is further adapted to hold the top of any wall panel installed below the at least one of the one or more horizontal reveals against the wall.

18. The Wall panel trim reveal system of claim 1, wherein the one or more horizontal trim pieces includes at least two horizontal reveals adapted to extend out past the bottom edge of the wall panel so as to be visible after installation of the wall panel, the at least two horizontal reveals being parallel and has a center reveal visible therebetween.

19. The wall panel trim reveal system of claim 1, wherein the horizontal reveal has or have a substantially vertical flat surface which is adapted to engage an inside surface of the at least one tab forming the slot.

* * * * *